US011763786B2

(12) United States Patent
Himstedt

(10) Patent No.: US 11,763,786 B2
(45) Date of Patent: Sep. 19, 2023

(54) MUSICAL INSTRUMENT, HAVING A DEVICE FOR TUNING TUNING BODIES, METHOD FOR RETUNING A MUSICAL INSTRUMENT AND USE OF A MUSICAL INSTRUMENT

(71) Applicant: Anapina Instruments GmbH, Pöcking (DE)

(72) Inventor: Thilo Himstedt, Pöcking (DE)

(73) Assignee: Anapina Instruments GmbH, Pöcking (DE)

( * ) Notice: Subject to any disclaimer, the term of this patent is extended or adjusted under 35 U.S.C. 154(b) by 48 days.

(21) Appl. No.: 17/616,099

(22) PCT Filed: Jun. 2, 2020

(86) PCT No.: PCT/DE2020/000120

§ 371 (c)(1),
(2) Date: Jul. 14, 2022

(87) PCT Pub. No.: WO2020/244694

PCT Pub. Date: Dec. 10, 2020

(65) Prior Publication Data

US 2022/0406278 A1 Dec. 22, 2022

(30) Foreign Application Priority Data

Jun. 5, 2019 (DE) ..... 10 2019 115 136.8

(51) Int. Cl.
*G10G 7/02* (2006.01)
*G10B 1/02* (2006.01)
*G10B 3/08* (2006.01)

(52) U.S. Cl.
CPC ..... *G10G 7/02* (2013.01); *G10B 1/02* (2013.01); *G10B 3/08* (2013.01)

(58) Field of Classification Search
CPC ..... G10G 7/02; G10B 1/02; G10B 3/08
See application file for complete search history.

(56) References Cited

U.S. PATENT DOCUMENTS 841,384 A * 1/1907 England ..... G10G 7/02 84/454
857,334 A * 6/1907 Galleazzi ..... G10G 7/02 84/456

(Continued)

FOREIGN PATENT DOCUMENTS

| | | |
|---|---|---|
| DE | 576 228 | 6/1935 |
| DE | 1 072 460 | 12/1959 |
| GB | 421298 | 12/1934 |

OTHER PUBLICATIONS

Written Opinion of the International Searching Authority (ISA), dated Oct. 9, 2020, (English Translation), (6 pages).

(Continued)

*Primary Examiner* — Robert W Horn
(74) *Attorney, Agent, or Firm* — Fresh IP PLC; Terrence L. B. Brown

(57) ABSTRACT

According to the invention, a musical instrument having a device for tuning tuning bodies is disclosed, a) having at least (12) mechanical tuning elements or tuning element systems, b) wherein the (12) mechanical tuning elements or tuning element systems represent the (12) chromatic notes of an octave, c) wherein in each case a tuning element or tuning element system is mechanically operatively connected to at least one tuning body, d) wherein each tuning element or tuning element system has exclusively octave-related tuning bodies associated with it, e) wherein during tuning of the musical instrument the tuning elements or tuning element systems are actuatable or actuated independently of one another, wherein the tuning elements are embodied as tuning levers and/or the tuning element systems are embodied as (Continued)

Figure 1:
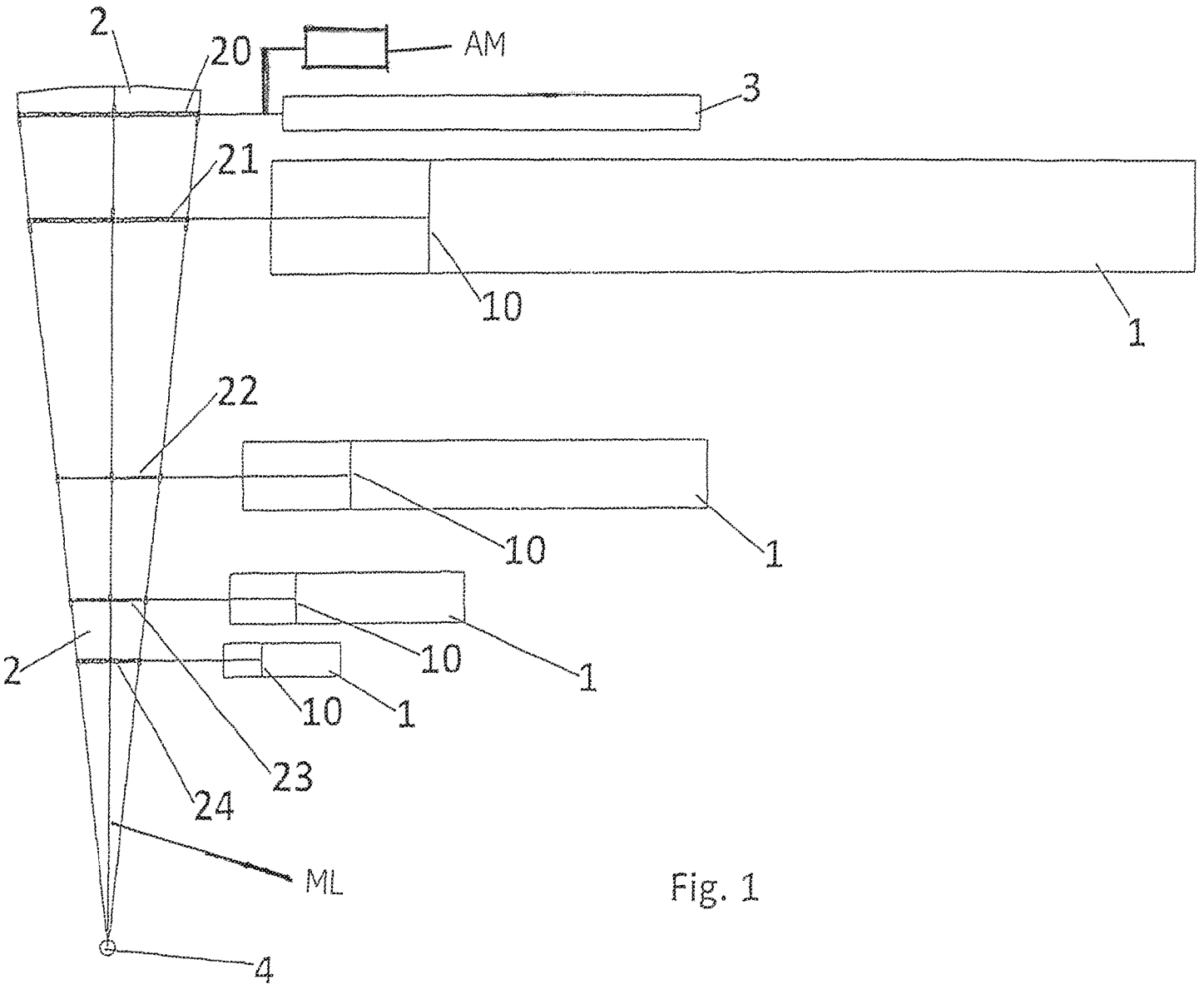

tuning lever systems, wherein a tuning lever system has at least two tuning levers that have differently located pivots, wherein the tuning levers are slidingly connected to one another by means of adjacent pivots, and wherein the geometric arrangement of the operative connections of the octave-related tuning bodies and the associated tuning elements in relation to one another is configured in the manner of an intercept theorem.

13 Claims, 2 Drawing Sheets

(56) References Cited

U.S. PATENT DOCUMENTS 1,125,502 A * 1/1915 Kratt ..... G10G 7/02 84/456
1,166,425 A * 1/1916 Kratt ..... G10G 7/02 84/456
1,356,706 A * 10/1920 Galleazzi ..... G10G 7/02 984/260
1,538,336 A * 5/1925 Kratt ..... G10G 7/02 984/260
1,796,795 A * 3/1931 Kratt ..... G10G 7/02 984/260
2,296,777 A * 9/1942 Elton ..... G10G 7/02 984/260
2,390,237 A * 12/1945 Bryant ..... G10G 7/02 984/260
2,514,315 A * 7/1950 Dickerson ..... G10G 7/02 984/260
2,723,583 A * 11/1955 Norris ..... G10G 7/02 984/260
2,779,920 A * 1/1957 Petroff ..... G01R 23/02 84/464 R
2,837,954 A * 6/1958 Kratt ..... G10G 7/02 984/260
2,871,747 A * 2/1959 Kratt ..... G10G 7/02 984/260
3,063,328 A * 11/1962 Greider ..... G10G 7/02 984/260
3,421,402 A * 1/1969 Musser ..... G10G 7/02 984/260
3,691,894 A * 9/1972 Schneider ..... G10G 7/02 984/260
4,038,899 A * 8/1977 MacMillan ..... G10G 7/02 984/260
9,012,752 B2 * 4/2015 Priest ..... G09B 15/00 84/470 R
2022/0406278 A1 * 12/2022 Himstedt ..... G10B 3/08

OTHER PUBLICATIONS

International Preliminary Report on Patentability (IPR), dated Dec. 7, 2021, (7 pages).
International Preliminary Report of Patentability (IPR), dated Dec. 7, 2021, (7 pages).
"Die Naturseptime" [The Harmonic Seventh], Martin Vogel, Verlag für systematische Muaikwissenschaft [Publisher for Dystematic Musicology] GmbH.

* cited by examiner

MUSICAL INSTRUMENT, HAVING A DEVICE FOR TUNING TUNING BODIES, METHOD FOR RETUNING A MUSICAL INSTRUMENT AND USE OF A MUSICAL INSTRUMENT

The invention relates to a musical instrument having a device for tuning tuning bodies, a method for retuning a musical instrument, and use of a musical instrument.

DE 1072460 discloses a device on musical instruments, in which the pitches are a function of the lengths of oscillating strings or air columns, wherein for rapid retuning of the overall instrument, a tuning lever that is rotatable about a fixed or virtual point is provided which acts jointly on the oscillatable members in such a way that when the tuning lever rotates, its absolute oscillation frequencies do not change with respect to its relative oscillation frequency ratios. The cited invention may be used for instruments having a pure tone design, on which the tone ratios of the fifth may be intoned to three half tones, of the third may be intoned to five quarter tones, and of the seventh may be intoned to seven quarter tones, and any desired number of segments from the tone network of pure fifths, thirds, and sevenths may be applied by adjusting the tuning lever on the keys; however, it is disadvantageous that the player requires two manuals for such an instrument, which are coordinated with one another in such a way that the notes that the player lacks on the one manual are available on the other manual. For transportable musical instruments, in particular positive organs, in many cases two-manual instruments already have a complicated mechanical structure and thus a heavy weight.

DE 576228 discloses a retuning device for pianos, in which equivalently named strings of all octaves are connected to shared tensioning devices, wherein various combinations of these tensioning devices are each activated via a particular key, in order to allow the overall instrument to be retuned in a predetermined manner (for example, changing from one musical key to the next within a just tuning) by activating a key. In this embodiment, a set of strings is fixedly connected to a frame at one end, and at the other end is connected to a short arm of a lever that is rotatably fastened to the frame, wherein a long arm of the lever is connected to a rotatable armature of a rotary magnet via a further articulated connection, wherein the armature supports a circular track on a radial arm, and multiple solenoids, provided with spring-mounted armatures, are arranged, which upon excitation of the solenoids are pressed against the track when an actuating member is actuated. These embodiments are very complicated, and therefore have a heavy weight and are not attractively priced.

Against this background, the resulting object of the present invention is to provide a musical instrument having a device for tuning tuning bodies, wherein the musical instrument per se is able to change from one musical key to another musical key in just tuning during play, while maintaining the just tuning and also keeping the mechanical complexity, and thus the weight and the cost, of such a musical instrument low.

The object is achieved according to the invention by a musical instrument according to the invention, a method of retuning a musical instrument according to the invention, and a method of using a musical instrument according to the invention.

The musical instrument according to the invention has a device for tuning tuning bodies, for example and in particular organ pipes, wherein the musical instrument has at least 12 mechanical tuning elements or tuning element systems, for example made up of tuning levers, wherein the 12 mechanical tuning elements or tuning element systems represent the 12 chromatic notes of an octave; i.e., for each note of an octave, which is formed from 12 notes, corresponding mechanical tuning elements or tuning element systems are present. In addition, in each case a tuning element or tuning element system is in mechanical operative connection with at least one tuning body, for example and in particular by means of rod-like actuation elements, wherein exclusively octave-related tuning bodies are associated with each tuning element or tuning element system; i.e., within an octave, equivalently named notes which, however, in absolute terms belong to different octaves and thus represent the so-called octave-related notes, are associated, so that for a pitch range of seven octaves, for example, a tuning element is connected to a total of eight octave-related tuning bodies, for example pipes, in each case via only one tuning element or only one tuning element system, and at the same time, during a retuning actuation of the tuning element or the tuning element system a simultaneous retuning of these octave-related notes takes place.

Lastly, during tuning of the musical instrument, the tuning elements or the tuning element systems are actuated or actuatable independently of one another, so that it is possible to provide any type of desired tuning, in particular also so-called just tuning, in any desired musical key, since the relative oscillation ratios of the octave-related notes remain constant relative to one another while the absolute pitches correspondingly change.

Also essential to the invention is the fact that in order to achieve a compact musical instrument that is also transportable if possible, and in addition the mechanics of such an instrument are not too complicated, resulting in excessive weight and cost, the musical instrument according to the invention the tuning elements are designed as tuning levers and/or the tuning element systems are designed as tuning lever systems, thus, systems that are made up of or have at least two or more tuning levers, wherein a tuning lever system has at least two tuning levers that have differently located pivot points, wherein the pivot points are slidingly connected to one another via adjacent pivot points, wherein the geometric arrangement of the operative connections of the octave-related tuning bodies and the associated tuning elements in relation to one another is configured in the manner of an intercept theorem.

This very specific feature combination results in a quite simple mechanical structure that may be designed to be very lightweight, and in addition a fairly high level of flexibility and compactness in the arrangement of the individual tuning bodies relative to one another, for example and in particular of organ pipes, is thus made possible. The musical instrument according to the invention may, but does not have to, be steplessly tuned in order to achieve the highest pitch resolution possible.

In this context, in practice it has proven advantageous that the actuation of each tuning element or each tuning element system takes place by means of a drive, for example and in particular an electric drive, for example and in particular an electric motor, since the start-up time and braking time, and thus the response times for a corresponding energization, are extremely short, and in principle rapid and reliable control is thus achievable.

Furthermore, it is advantageous when the musical instrument is configured in such a way that during tuning, all intervals of a chord and all chords may be rendered in just tuning relative to one another, for example and in particular when the drives are controlled by means of an electronic control unit, for example and in particular when the electronic control unit is programmable, so that in advance of playing, for example and in particular the necessary musical keys and thus the musical key sequence may be programmed in, so that via one or more actuating members, for example and in particular when the musical instrument has one or more actuating members for retuning, retuning may then be performed, for example and in particular via an operable screen or hand switch or foot switch, for example and in particular in the form of a pedal or in the form of a foot piston (corresponding to an organ), in order to ensure the most fluid playing possible in each musical key within the just tuning, since based on the system, retunings from musical key to musical key must be performed in order to provide the necessary relative ratios of the chromatic 12 notes of an octave while playing, since the commas (Pythagorean comma, third comma, septimal comma, etc.) that inevitably occur in just tuning are not leveled by tempering of whatever kind.

Moreover, it is very advantageous that the connection between the tuning lever or tuning lever system and the tuning body has a sliding design, since due to the intercept theorem-like geometric arrangement of the operative connections of the octave-related tuning bodies and the associated tuning elements relative to one another, no blocking effect due to orthogonal components thus occurs upon actuation of the tuning elements for actuating tuning of the tuning bodies, for example and in particular when the tuning bodies are pipes having displaceable piston elements, which in this regard changes the air column to be activated within the pipe (thereby performing retuning).

It is particularly advantageous when the musical instrument is designed in such a way that the actuation of an octave-related note having a higher frequency than an octave-related note having a lower frequency is achieved in a stepped-down manner, which for example and in particular is achieved by the intercept theorem-like geometric arrangement of the operative connections of the octave-related tuning bodies and the associated tuning elements relative to one another. This also ensures consistent accuracy of the retuning at high frequencies, and thus the upper octaves, in relation to the lower octaves.

In general, for achieving artistic needs such as performing glissandi, for the musical instrument according to the invention it is advantageous for the operative connection to be designed in such a way that the tuning bodies for each tuning element have a retuning range of 300 cents in each case.

One particularly uncomplicated and simple embodiment of the musical instrument according to the invention is achieved when only one tuning lever or one tuning lever system is associated, at least for a portion of the octave-related tuning bodies based on an octave tone, so that for the 12 notes of an octave, for the overall musical instrument only 12 tuning elements, in particular tuning levers, or tuning element systems, for example and in particular tuning lever systems, the octave-related tuning body, and its octave-related notes are then actually included. In this context, it is particularly advantageous when the musical instrument is configured in such a way that with respect to an octave tone, which relates solely to the theoretical note within an octave and which initially is thus independent of the frequency, for each octave-related tuning body a tuning lever of the tuning lever system is operatively connected to this tuning body, so that a much freer spatial configuration of the individual tuning bodies, in particular pipes, is made possible by the implementation of the tuning lever system and the associated tuning levers.

The musical instrument according to the invention relates in particular to a portable positive organ that weighs only a few hundred kilograms, and that for an organ instrument is thus still considered to be transportable, with correspondingly reliable mechanics, so that from a musical standpoint, for any type of tuning a change may be made within a given musical key and in both tonal modes while playing, resulting in particularly promising musical and esthetic aspects while playing, in particular for just tuning. With regard to the individual tunings, in particular tempered tunings and just tuning, reference is made to the general technical literature, for example and in particular German patent publications DE 576228 and DE 1072460 and "Die Naturseptime" [The Harmonic Seventh], Martin Vogel, Verlag für systematische Musikwissenschaft [Publisher for Systematic Musicology] GmbH, Bonn-Bad Godesberg, 1991.

The length of the retuning levers is usually 30 to 150 cm, with fiber-reinforced composites (GFRP, CFRP) and aluminum generally being suitable. The linear guides (slides) customarily have adjustable play and per se have a maintenance-free design, with the material of the linear guides (slides) being aluminum or steel. The linear guides themselves have a low sliding resistance, and are generally quiet with a flat design; one of the leading manufacturers of linear guides is Rollon GmbH, Germany (www.rollon.com).

In addition, it is advantageous that the at least one tuning body is a tunable pipe having an adjustable piston element in order to achieve rapid and reliable tuning of the pipe in a relatively elegant manner.

Furthermore, it is advantageous when the mechanical operative connection between at least one tuning element, in particular a tuning lever, or a tuning element system, in particular a tuning lever system, and at least one tuning body, in particular a pipe, in particular an organ pipe, is adjustable, in particular when the operative connection is adjustable in two mutually orthogonal directions, in particular as described below.

The lengths of all piston axes are adjustable in order to produce the octave intervals between the individual tuning bodies, which are connected to a tuning lever or to a tuning lever system.

In order to make identical settings for the octave characteristic, i.e., the extent of the retuning range of the tuning bodies (300 cents, for example) that are connected to a tuning lever or to a tuning element system, in particular a tuning lever system, the positions of all tuning bodies are also adjustable perpendicularly with respect to their length, and thus also perpendicularly with respect to the middle position of the tuning lever or tuning lever system.

These two settings constitute the basic configuration of the instrument, since in practice the positions of the tuning elements cannot be calculated precisely. The settings must be made manually, and are necessary in order for the instrument to produce in a precise and beatless manner the intervals between the tuning bodies called up by the player by means of the tuning levers or tuning lever systems, even after many retunings. This applies in particular for the embodiment illustrated in FIG. 1.

Figure 2:
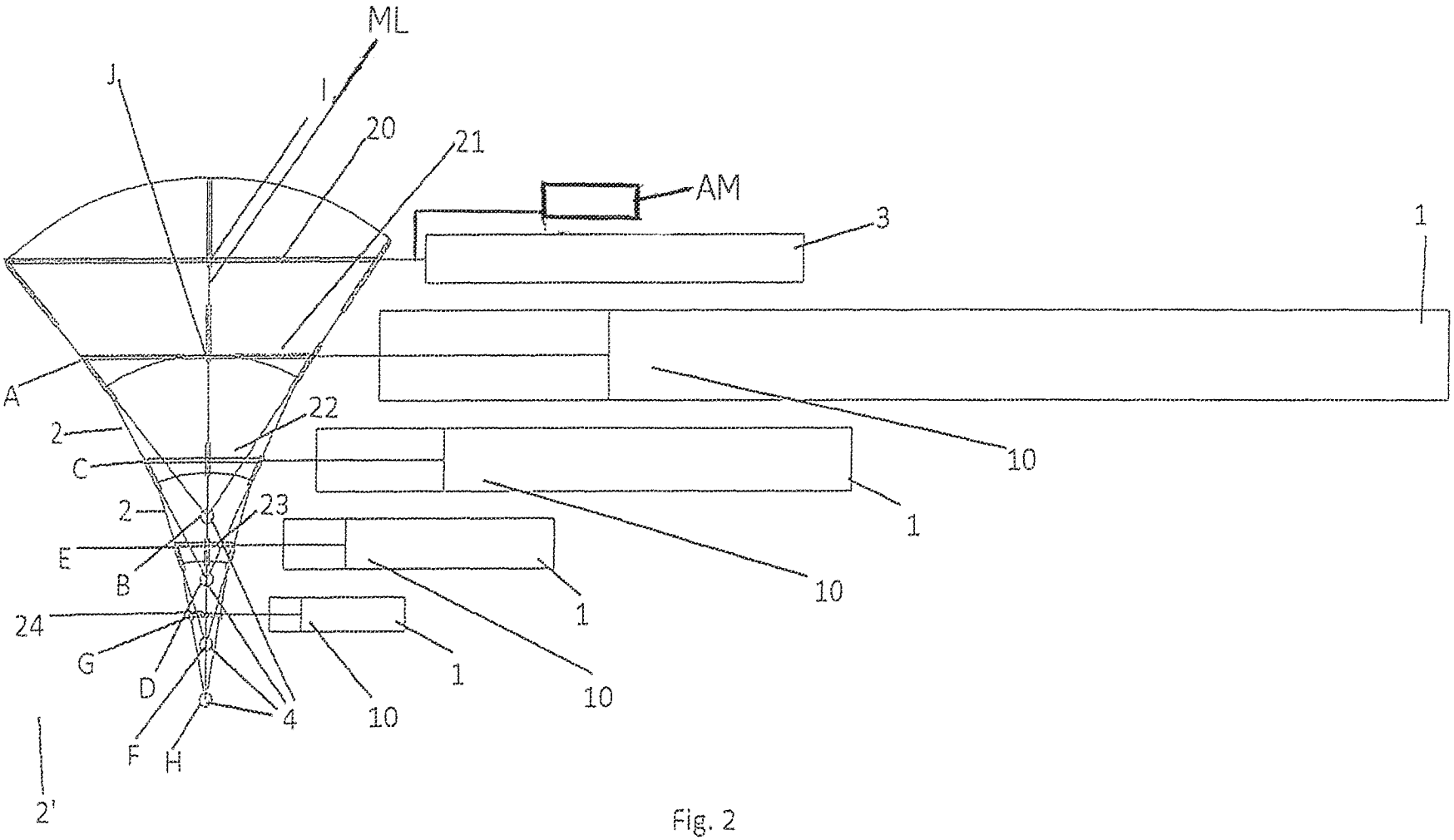

The following embodiments serve solely to explain the invention in a nonlimiting manner, wherein:

FIG. 1 shows a schematic illustration of a first embodiment of the musical instrument according to the invention; and FIG. 2 shows a schematic illustration of a second embodiment of the musical instrument according to the invention.

It is apparent from the schematic illustration in FIG. 1 that in this case four tuning bodies 1 in the form of pipes having displaceable piston elements 10 are in operative connection with the tuning element 2 in the form of a tuning lever, wherein the tuning lever 2 is rotatable about the pivot point 4, and the actuating rotation of the tuning lever 2 is actuatingly controlled by means of an electric drive 3 in the form of an electric motor for a retuning in question, for example by actuating an actuating member AM, for example and in particular in the form of a switch. Three different rotational positions of the tuning lever 2 are apparent in FIG. 1; according to the intercept theorem laws, from top to bottom, the linear displacements of the piston elements (not shown) of the tuning bodies 1 are achieved in a stepped-down manner from top to bottom, so that accurate and reliable retuning is achieved with regard to the octave-related third, even for the highest-pitch organ pipe 1 and the lowest-pitch organ pipe 1.

A further embodiment of such a design is apparent in FIG. 2; in contrast, instead of a tuning lever 2 a tuning lever system 2' is illustrated, which in this case has four tuning levers 2 which are slidingly connected to one another, and which due to the distances between the four pivot points 4 also allow other geometric ratios with regard to the arrangement of the individual organ pipes 1.

The retuning device shown in FIG. 2 is in a manner of speaking a refinement of that shown in FIG. 1, wherein the levers AB, CD, EF, GH are connected to one another so that they respond jointly when the servomotor 3 is actuated, wherein AB is rotatably mounted at point B, CD is rotatably mounted at point D, EF is rotatably mounted at point F, and GH is rotatably mounted at point H, and in addition CD is connected to the lever AB at point C and is moved via AB, EF is connected to the lever CD at point E and is moved via CD, and GH is connected to the lever EF at point G and is moved via EF. Each resonator is retuned corresponding to its octave, wherein the retuning distances of the tuning bodies are in a 2:1 ratio in each case. In FIG. 2, no identifiers/letters of the contact points of the levers are present on the right side of the lever system. Therefore, the information refers to the center line (ML):

A to ML is twice as long as C to ML

C to ML is twice as long as E to ML

E to ML is twice as long as G to ML.

The left side of the distances indicated above shows the maximum deflection of the levers in the direction of lengthening of the organ pipes, and thus their frequency shift to lower notes, wherein the right side of the corresponding distances brings about the maximum deflection of the levers in the direction of shortening of the organ pipes, and thus an increase in the pitches.

The lever AB is moved over the extension A-A via the servomotor, wherein the piston rods (not shown) of the individual tuning bodies 1 are guided on a linear guide and the levers AB, CD, EF, and GH are sliding connected to one another, so that the intercept theorem laws may be applied. The distances between the pivot bearings B, D, F, and H are freely positionable, so that the tuning bodies may be configured essentially as desired, and each tuning body may still be retuned according to its octave register.

The octaves between the tuning bodies 1 are tuned over the length of the piston rods (not shown), wherein the retuning distance of the individual tuning bodies 1 over the displacement C, E, and G is corrected, so that the octave interval is maintained over the entire retuning distance.

With regard to FIG. 1:

All pipes are octave-related. This is reflected in their lengths and in the distances to the fixed pivot point of the retuning lever.

The end of the pipes having the pistons is brought closer to the retuning lever with an identical distance.

The deflection of the retuning lever in the direction of raised pitch is slightly less than in the direction of lowered pitch.

The position of the linear motor is freely customizable. The shorter the retuning lever, the greater its rotational movement.

With regard to FIG. 2:

Refinement of tuning mechanism 1

Additional advantage: Completely free positioning of the pipes. Any configuration of the pipes is achievable via the lengths of the levers or the position of their pivot points—in the present diagram, for example with an identical distance between the pipe walls.

In the present diagram, the linear motor and the lowest-pitch pipe are directly connected to a lever. The linear motor may still be freely positioned in this case, since its movements are programmable as desired. However, a configuration with a dedicated lever for the linear motor and the lowest-pitch in each case are also conceivable.

For each pipe and linear motor, one lever is the maximum solution. However, it is also possible to freely move more than one pipe via one lever.

The rotational movement of the levers is converted into a translational movement by the linear guides. In this way the intercept theorem laws are not violated. Two linear guides always cooperate: A linear guide in each case is mounted on the lever, and a second linear guide is mounted on the piston axis. The middle three linear guides (No. 2, No. 3, No. 4) in each case have the dual task of coordinating the movement of two levers with one another and coordinating the movement of a piston axis. The cooperating linear guides are in each case perpendicular to one another in the middle position of the levers (12 o'clock). (It is important to use linear guides having adjustable bearing play for precise transmission of the lever movements.)

For further minimizing the space, the ends of the pipes on the piston side are brought closer to the outermost lever position in the direction of raised pitch with an identical distance.

The outermost lever position in the direction of raised pitch has a slightly smaller deflection than the outermost lever position in the direction of lowered pitch.

In the embodiments shown in FIG. 1 and also in FIG. 2, the tuning bodies are organ pipes having adjustable piston elements, wherein the mechanical operative connection between at least one tuning lever 2 or one tuning lever system 2' and at least one organ pipe 1, in particular in two mutually orthogonal directions, is adjustable in order to take into account the particular instrument-specific locations of the tuning bodies relative to one another and to the tuning element 2 or tuning element system 2' in such a way that in practice, relatively rapid tuning of the musical instrument according to the invention is then achievable, so that in practice the octave series of the organ pipes may then be retuned.

The invention claimed is:

1. Musical instrument having a device for tuning tuning bodies (1), a) having at least 12 mechanical tuning elements (2) or tuning element systems (2'), b) wherein the 12 mechanical tuning elements (2) or tuning element systems (2') represent the 12 chromatic notes of an octave, c) wherein in each case a tuning element (2) or tuning element system (2') is in mechanical operative connection with at least one tuning body (1), d) wherein exclusively octave-related tuning bodies are associated with each tuning element (2) or tuning element system (2'), e) wherein during tuning of the musical instrument, the tuning elements (2) or tuning element systems (2') are actuated or actuatable independently of one another, wherein the tuning elements (2) are designed as tuning levers and/or the tuning element systems (2') are designed as tuning lever systems, wherein a tuning lever system has at least two tuning levers that have differently located pivot points (4), wherein the tuning levers are slidingly connected to one another via adjacent pivot points (4), and wherein the geometric arrangement of the operative connections of the octave-related tuning bodies (1) and the associated elements (2) in relation to one another is configured in the manner of an intercept theorem.

2. Musical instrument according to claim 1 wherein the musical instrument is configured in such a way that during tuning, all intervals of a chord and all chords may be rendered in pure tuning relative to one another.

3. Musical instrument according to claim 1, wherein the connection between the tuning lever or tuning lever system and the tuning body (1) has a sliding design.

4. Musical instrument according to claim 1, wherein the design is such that the actuation of an octave-related note having a higher frequency compared to an octave-related note having a lower frequency is achieved in a stepped-down manner.

5. Musical instrument according to claim 4, wherein the mechanical operative connection is designed in such a way that the tuning bodies (1) for each tuning element (2) have a retuning range of 300 cents in each case.

6. Musical instrument according to claim 1, wherein only one tuning lever or one tuning lever system is associated, at least for a portion of the octave-related tuning bodies (1) based on an octave tone, up to only one tuning lever or one tuning lever system being associated for each octave-related tuning body (1) based on an octave tone.

7. Musical instrument according to claim 1, wherein the musical instrument is configured in such a way that a tuning lever of the tuning lever system is operatively connected to this tuning body (1), for up to each octave-related tuning body (1) based on an octave tone.

8. Musical instrument according to claim 1, wherein the musical instrument has at least one actuating member for retuning.

9. Musical instrument according to claim 1, wherein at least one tuning body (1) is a tunable pipe having an adjustable piston element (10).

10. Musical instrument according to claim 1, wherein the mechanical operative connection between at least one tuning element (2) or tuning element system (2') and at least one tuning body (1) is adjustable.

11. Musical instrument according to claim 10, wherein the operative connection is adjustable in two mutually orthogonal directions.

12. Method for retuning a musical instrument having a device for tuning tuning bodies (1), the method comprising:

a) providing the musical instrument, the musical instrument including:

a device for tuning tuning bodies (1);

at least 12 mechanical tuning elements (2) or tuning element systems (2');

the 12 mechanical tuning elements (2) or tuning element systems (2') represent the 12 chromatic notes of an octave;

in each case a tuning element (2) or tuning element system (2') is in mechanical operative connection with at least one tuning body (1);

exclusively octave-related tuning bodies are associated with each tuning element (2) or tuning element system (2');

during tuning of the musical instrument, the tuning elements (2) or tuning element systems (2') are actuated or actuatable independently of one another;

the tuning elements (2) are designed as tuning levers and/or the tuning element systems (2') are designed as tuning lever systems;

a tuning lever system has at least two tuning levers that have differently located pivot points (4), wherein the tuning levers are slidingly connected to one another via adjacent pivot points (4), and the geometric arrangement of the operative connections of the octave-related tuning bodies (1) and the associated elements (2) in relation to one another is configured in the manner of an intercept theorem; and b) retuning the musical instrument.

13. Method for retuning a musical instrument having a device for tuning tuning bodies (1), the method comprising:

a) providing the musical instrument, the musical instrument including:

a device for tuning tuning bodies (1);

at least 12 mechanical tuning elements (2) or tuning element systems (2');

the 12 mechanical tuning elements (2) or tuning element systems (2') represent the 12 chromatic notes of an octave;

in each case a tuning element (2) or tuning element system (2') is in mechanical operative connection with at least one tuning body (1);

exclusively octave-related tuning bodies are associated with each tuning element (2) or tuning element system (2');

during tuning of the musical instrument, the tuning elements (2) or tuning element systems (2') are actuated or actuatable independently of one another;

the tuning elements (2) are designed as tuning levers and/or the tuning element systems (2') are designed as tuning lever systems;

a tuning lever system has at least two tuning levers that have differently located pivot points (4), wherein the tuning levers are slidingly connected to one another via adjacent pivot points (4), and the geometric arrangement of the operative connections of the octave-related tuning bodies (1) and the associated elements (2) in relation to one another is configured in the manner of an intercept theorem; and b) retuning the musical instrument; and c) using the musical instrument for playing in any musical key of the circle of fifths, defined with regard to tempered tuning, in pure tuning by means of retuning while playing; and/or for playing in such a way that during tuning, all intervals of a chord and all chords may be rendered in pure tuning relative to one another.

* * * * *